US008166572B1

(12) United States Patent
Campbell et al.

(10) Patent No.: US 8,166,572 B1
(45) Date of Patent: May 1, 2012

(54) SLEEPING BAG SYSTEMS

(76) Inventors: Debra J. Campbell, Tempe, AZ (US); James A. Klomp, Bend, OR (US)

( * ) Notice: Subject to any disclaimer, the term of this patent is extended or adjusted under 35 U.S.C. 154(b) by 387 days.

(21) Appl. No.: 12/539,479

(22) Filed: Aug. 11, 2009

Related U.S. Application Data

(60) Provisional application No. 61/118,933, filed on Dec. 1, 2008, provisional application No. 61/088,120, filed on Aug. 12, 2008.

(51) Int. Cl.
*A47G 9/08* (2006.01)

(52) U.S. Cl. ..... 2/69.5; 5/413 R

(58) Field of Classification Search ..... 2/69, 69.5, 2/80, 79, 88, 84, 83; 5/413 R, 413 AM, 494
See application file for complete search history.

(56) References Cited

U.S. PATENT DOCUMENTS

| | | | | |
|---|---|---|---|---|
| 2,911,649 | A | 11/1959 | Ruelle et al. | |
| 3,924,273 | A | 12/1975 | Donovan | |
| 4,125,910 | A * | 11/1978 | Nicholai | 2/69.5 |
| 4,484,362 | A | 11/1984 | Asher | |
| 4,507,805 | A | 4/1985 | Calutoiu | |
| 4,575,876 | A * | 3/1986 | Weaver | 2/69.5 |
| 4,599,075 | A | 7/1986 | Nygard | |
| 4,674,130 | A | 6/1987 | Coudron | |
| 5,611,082 | A | 3/1997 | Bull | |
| 6,334,221 | B1 | 1/2002 | Hope | |
| 6,421,834 | B2 | 7/2002 | Kester | |
| 6,591,426 | B1 * | 7/2003 | Smith | 2/69 |
| 7,647,656 | B2 * | 1/2010 | Smith | 5/413 R |
| 2001/0025384 | A1 | 10/2001 | Kester | |
| 2004/0128731 | A1 | 7/2004 | Marty et al. | |
| 2005/0177921 | A1 | 8/2005 | Rodriguez et al. | |
| 2007/0050882 | A1 | 3/2007 | Eisenhuth | |
| 2008/0120774 | A1 | 5/2008 | Hite | |

FOREIGN PATENT DOCUMENTS

| | | | |
|---|---|---|---|
| EP | 26151 | A1 | 4/1981 |
| WO | WO9851199 | A1 | 11/1998 |
| WO | WO2006116680 | A2 | 11/2006 |

OTHER PUBLICATIONS http://www.musuchouse.com/HTML/selkbag_ing.html, Ralonso Rodrigo Alonso's design studio, Selk'Bag, date unknown, 1 page, internet.

http://www.productdose.com/article.php?article_id=659, productdose.com, Walking Sleeping Bag, date unknown, 1 page, internet.

http://answers.yahoo.com/question/index?qid=20071216163832AAHmQEb, Yahoo Answers, Resolved Question, Where can I find a sleeping bag with a zipper for your feet so you can stand up?, date unknown, 1 page, internet.

(Continued)

*Primary Examiner* — Danny Worrell, Jr.

(74) *Attorney, Agent, or Firm* — Stoneman Law Patent Group; Martin L. Stoneman; Eric Fish

(57) ABSTRACT

A sleeping bag system relating to assisting a user to choose to walk, stand upright, sit, use one's arms and hands, or be otherwise mobile while inside the comfort and warmth of a sleeping bag. The system also provides for full enclosure within the sleeping bag as well as hygienic access without exiting the sleeping bag.

27 Claims, 3 Drawing Sheets

OTHER PUBLICATIONS http://www.backcountry.com/outdoorgear/Exped-Wallcreeper-PL-Sleeping-Bag-40-Degree-Synthetic/ODR0047M.html?CMP_ID=SH_FRO001&CMP_SKU=&mv_pc=r126, backcountry.com, Exped Wallcreeper PL Sleeping Bag, 40 degree synthetic, date unknown, 1 page, internet.

http://www.backpackgeartest.org/reviews/Sleep%20Gear/Sleeping%20Bags/Exped%20Wall%20Creeper/Chuck%20Kime/Field%20Report/, Backpack Gear Test, Exped Wallcreeper PL Sleeping Bag, date unknown, 1 page, internet.

http://west.loadup.com/military/surplus/451237.html, Loadup.com, Austrian Sniper Sleeping Bag, date unknown, 1 page, internet.

http://www.surplusandadventure.com/shopscr1753.html, Genuine German Army Sniper Sleeping Bag, date unknown, 1 page, internet.

http://selkbag.inspires.me.uk/, selk bag sleep wear system, date unknown, 1 page, internet.

* cited by examiner

SLEEPING BAG SYSTEMS

CROSS-REFERENCE TO RELATED APPLICATION

The present application is related to and claims priority from prior provisional application Ser. No. 61/088,120, filed Aug. 12, 2008, entitled "Walking Mummy Bag—a mummy style sleeping bag modified for walking around and sitting near the campfire"; and, this application is related to and claims priority from prior provisional application Ser. No. 61/118,933, filed Dec. 1, 2008, entitled "SLEEPING BAG SYSTEMS", the contents of all of which are incorporated herein by this reference and are not admitted to be prior art with respect to the present invention by the mention in this cross-reference section.

BACKGROUND

This invention relates to providing a system relating to sleeping bags. More particularly, this invention relates to providing a system for assisting a user to walk while in a sleeping bag. Sleeping bags are often utilized while camping or during recreational activities outdoors. There are many instances when a sleeping bag user might prefer to stand upright, to sit, to walk, or be otherwise mobile and would prefer to maintain the comfort and warmth of a sleeping bag; for example, movement around a tent, sitting outside, sitting near a campfire, watching the stars, etc. In addition, while in a sleeping bag one may need to perform hygienic positioning that normally requires the user to leave the comfort of a sleeping bag. It would be very useful to have a sleeping bag that would allow one to be mobile. It would be very useful to have a sleeping bag that would allow one to comfortably sit in a chair. It would be very useful to have a sleeping bag with a feature to assist hygienic positioning without having to get out of the sleeping bag.

Even further, there are many instances when a user would like to use their arms and hands and yet still be within the comfort and warmth of the sleeping bag. For example, when cold outside and a user decides to make a meal it would be very useful to have use of one's arms and hands for cooking, grasping utensils, and other small motor control movements. Current sleeping bags do not provide such features.

OBJECTS AND FEATURES OF THE INVENTION

A primary object and feature of the present invention is to provide a system overcoming the above-mentioned problems.

It is a further object and feature of the present invention to provide such a system comprising a sleeping bag which may be used for both sleeping and walking around.

It is a further object and feature of the present invention to provide such a system comprising a sleeping bag with arm-holding appendages that allow an extension of a user's arms away from the main torso in a full range of motion.

It is a further object and feature of the present invention to provide such a system comprising a sleeping bag with at least one first leg-holding portion that will preferably house both legs of a user for use while sleeping, and at least one second leg-holding portion that will preferably house at least one leg of such user for assisting walking around in such sleeping bag.

It is a further object and feature of the present invention to provide such a system comprising removably attached socks extending from such leg-holding portions into which a user may extend a foot into each respective sock.

It is a further object and feature of the present invention to provide such a system comprising removably attached gloves extending from such arm-holding portions into which a user may extend a hand into each respective glove.

It is a further object and feature of the present invention to provide such a system comprising a sleeping bag with a feature to assist hygienic positioning without having to get out of the sleeping bag.

It is a further object and feature of the present invention to provide such a system comprising a sleeping bag having zippered side ingress-egress access to the sleeping bag interior.

Another object and feature of the present invention is to provide such a system that is efficient, inexpensive, and handy.

Other objects and features of this invention will become apparent with reference to the following descriptions.

SUMMARY OF THE INVENTION

In accordance with a preferred embodiment hereof, this invention provides a sleeping bag system, relating to providing at least one user with a sleeping bag which may be used for both sleeping and walking around, comprising: at least one sleeping bag container structured and arranged to contain at least the torso of the at least one user; wherein such sleeping bag container comprises at least one ingress-egress element adapted to assist ingress-egress into and out of such sleeping bag container; wherein such sleeping bag container comprises a first leg-container adapted to hold at least both legs of the at least one user; wherein such sleeping bag container comprises a second leg-container adapted to hold only one leg of the at least one user; wherein such sleeping bag container comprises at least one insulator element adapted to provide insulation to such at least one user when such at least one user is at least partially contained within such sleeping bag container; wherein such first leg-container comprises at least one first walk assister adapted to assist user walking when at least a first single foot portion of at least one first such leg is extended into such first walk assister; wherein such second leg-container comprises at least one second walk assister adapted to assist user walking when at least a second single foot portion of at least one second such leg is extended into such second walk assister; wherein such system enables the user to walk around when one of the user's legs is within such first leg-container and one of the users legs is in such second leg-container; and, wherein such system assists the user to sleep in such at least one sleeping bag container with both legs of the user in such first leg-container.

Moreover, it provides such a sleeping bag system wherein such sleeping bag container further comprises: a first arm-extender element adapted to assist extending a first arm of the user; and a second arm-extender element adapted to assist extending a second arm of the user; wherein the user may extend both arms in a range of motion at least transverse from such sleeping bag container while such user is contained within such sleeping bag container. Additionally, it provides such a sleeping bag system wherein such at least one ingress-egress element comprises: at least one side ingress-egress element adapted to providing side ingress-egress to such sleeping bag container; wherein such side ingress-egress element provides ingress-egress access to at least the torso of such at least one user.

Also, it provides such a sleeping bag system wherein such side ingress-egress element comprises at least one zipper. In addition, it provides such a sleeping bag system wherein such first arm-extender element comprises a first glove adapted to allow insertion of a first hand of the user into such first glove. And, it provides such a sleeping bag system wherein such second arm-extender element comprises a second glove adapted to allow insertion of a second hand of the user into such second glove. Further, it provides such a sleeping bag system wherein: such first glove is removably attachable to such first arm-extender element; and such second glove is removably attachable to such second arm-extender element. Even further, it provides such a sleeping bag system wherein the first arm-extender comprises a first hand-passage adapted to assist passage of the first hand of the user outwardly from the first arm-extender element.

Moreover, it provides such a sleeping bag system wherein the first hand-passage comprises at least one elastic closure structured and arranged to maintain such first hand-passage in a closed position when a hand is not inserted through such first hand-passage. Additionally, it provides such a sleeping bag system wherein the second arm-extender comprises a second hand-passage adapted to assist passage of the second hand of the user outwardly from the second arm-extender element. Also, it provides such a sleeping bag system wherein the second hand-passage comprises at least one elastic closure structured and arranged to maintain such second hand-passage in a closed position when a hand is not inserted through such second hand-passage. In addition, it provides such a sleeping bag system wherein such first leg-container comprises a first sock adapted to allow insertion of a first foot of the user into such first sock. And, it provides such a sleeping bag system wherein such second leg-container comprises a second sock adapted to allow insertion of a second foot of the user into such second sock.

Further, it provides such a sleeping bag system wherein: such first sock is removably attachable to such first leg-container; and such second sock is removably attachable to such second leg-container. Even further, it provides such a sleeping bag system wherein such first leg-container comprises a first leg-passage element adapted to assist passage of the first leg of the user outwardly from the first leg-container element. Moreover, it provides such a sleeping bag system wherein the first leg-passage element comprises at least one elastic closure structured and arranged to maintain such first leg-passage in a closed position when a leg is not inserted through such first leg-passage. Additionally, it provides such a sleeping bag system wherein such second leg-container comprises a second leg-passage element adapted to assist passage of the second leg of the user outwardly from the second leg-container element. Also, it provides such a sleeping bag system wherein the second leg-passage element comprises at least one elastic closure structured and arranged to maintain such second leg-passage in a closed position when a leg is not inserted through such second leg-passage.

In addition, it provides such a sleeping bag system wherein such sleeping bag container further comprises at least one closable opening situate at least at the intersection of such first leg-container and such second leg-container. And, it provides such a sleeping bag system wherein such at least one closable opening comprises at least one zipper structured and arranged to both open such at least one closable opening and close such at least one closable opening. Further, it provides such a sleeping bag system wherein such at least one closable opening is structured and arranged to provide hygienic access to at least the groin area of the at least one user. Even further, it provides such a sleeping bag system wherein such at least one closable opening is about six-inches to about twenty four inches in length. Even further, it provides such a sleeping bag system wherein such at least one closable opening is essentially situate along such second leg-container.

Even further, it provides such a sleeping bag system further comprising hook and loop fabric structured and arranged to removably attach such first glove to such first arm-extender element and such second glove to such second arm-extender element. Even further, it provides such a sleeping bag system further comprising hook and loop fabric structured and arranged to removably attach such first sock to such first leg-container and such second sock to such second leg-container.

In accordance with another preferred embodiment hereof, this invention provides a sleeping bag system, relating to providing at least one user with a sleeping bag which may be used for both sleeping and walking around, comprising: sleeping bag torso container means for containing at least the torso of such at least one user; wherein such sleeping bag container means comprises at least one ingress-egress means for ingress-egress into such sleeping bag container means wherein such sleeping bag container means comprises first leg-container means for holding at least both legs of the user; wherein such sleeping bag container means comprises second leg-container means for holding only one leg of the user; wherein such user-container means comprises insulator means for providing insulation to such at least one user when such at least one user is at least partially contained within such user-container means; wherein such first leg-container means comprises first walk assister means for assisting user walking when a single foot portion of at least one such leg is extended into such first walk assister means; wherein such second leg-container means comprises second walk assister means for assisting user walking when a single foot portion of such leg is extended into such second walk assister means; and wherein such system enables the user to walk around when one of the user's legs is within such first leg-container means and one of the users legs is in such second leg-container means.

Even further, it provides such a sleeping bag system wherein such sleeping bag container means further comprises: first arm extender means for extending a first arm of the user; and second arm extender means for extending a second arm of the user; wherein a user may extend both arms transverse from such sleeping bag torso container means while such torso is contained within such sleeping bag torso container means. Even further, it provides such a sleeping bag system wherein such at least one ingress-egress means comprises: at least one side ingress-egress means for providing side ingress-egress to such sleeping bag torso container means; wherein such side ingress-egress means provides ingress-egress for at least the torso of such at least one user.

In accordance with another preferred embodiment hereof, this invention provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1:
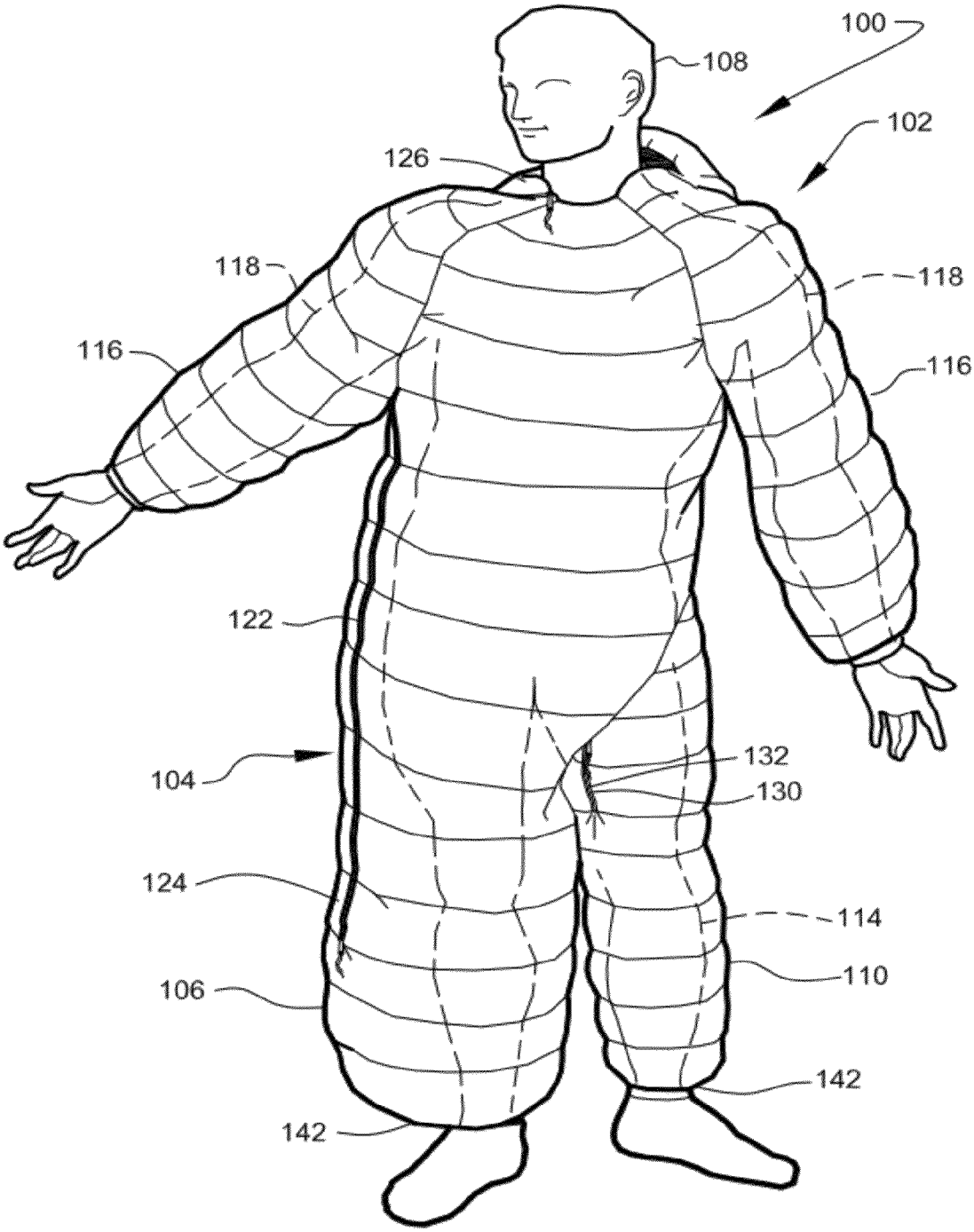
FIG. 1 shows a front perspective view, illustrating a sleeping bag of the sleeping bag systems, according to a preferred embodiment of the present invention.
Figure 2:
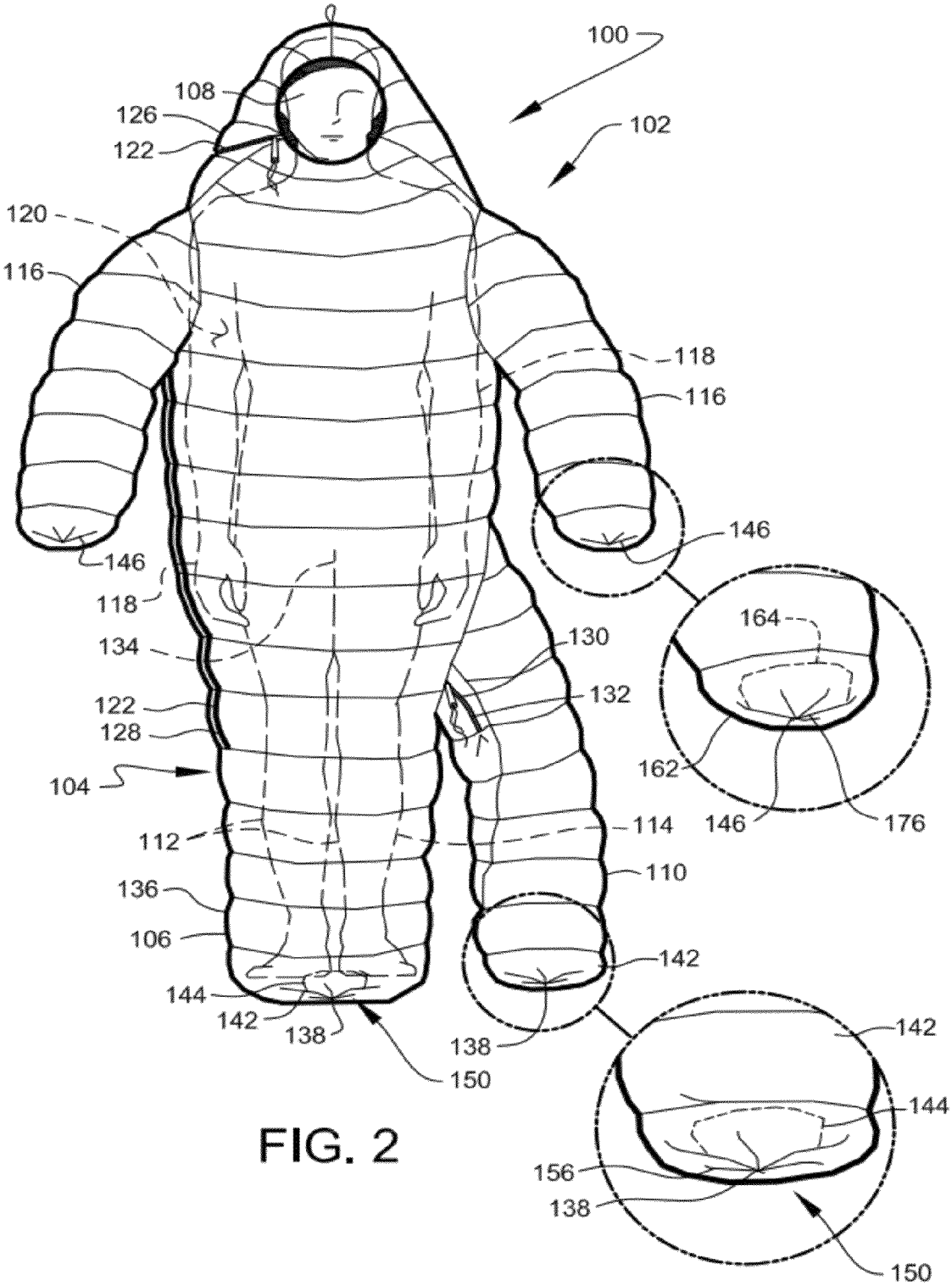
FIG. 2 shows a front cut-away view, illustrating a user in a sleep position in the sleeping bag of the sleeping bag systems, according to the preferred embodiment of FIG. 1.

FIG. 1 shows a front perspective view, illustrating a sleeping bag 102 of the sleeping bag systems 100, according to a preferred embodiment of the present invention. FIG. 2 shows a front cut-away view, illustrating a user in a sleeping position in the sleeping bag 102 of the sleeping bag systems 100, according to the preferred embodiment of FIG. 1.

Sleeping bag 102 preferably comprises at least a torso-enclosing mummy-style sleeping bag portion 104 having an insulated interior portion 120, preferably so that when used in a cold climate the temperature on the exterior of the sleeping bag 102 is well above that of the insulated interior portion 120 (at least embodying herein wherein such user-container means comprises insulator means for providing insulation to such at least one user when such at least one user is at least partially contained within such user-container means). Preferably, sleeping bag 102 is made available in a variety of insulated profiles (for example—ratings for above freezing, below freezing, etc.). Those with ordinary skill in the art will now appreciate that upon reading this specification and by their understanding the art of insulated sleeping bags as described herein, methods of providing such insulation will be understood by those knowledgeable in such art.

Sleeping bag 102 preferably comprises at least a torso-enclosing mummy-style sleeping bag portion 104 (at least embodying herein sleeping bag torso container means for containing at least the torso of such at least one user) having at least one first leg-holding portion 106 that will preferably house both legs 112 of a user 108, and at least one second leg-holding portion 110 that will preferably house at least one leg 114 of such user 108, highly preferably only one single leg 114 of such user 108, as shown. Further, it is preferably that a user may retract the leg 114 from such at least one second leg-holding portion 110 (at least embodying herein wherein such sleeping bag container means comprises second leg-container means for holding only one leg of the user) to place such leg 114 into first leg-holding portion 106 (at least embodying herein wherein such sleeping bag container means comprises first leg-container means for holding at least both legs of the user), such as, for example, for sleep positioning, as shown. Upon reading this specification, those with ordinary skill in the art will now appreciate that, under appropriate circumstances, considering such issues as design preference, user preferences, marketing preferences, cost, structural requirements, available materials, technological advances, etc., other leg placement arrangements such as, for example, placing both legs into a larger first or second leg-holding portion to accommodate sleeping on one's side, placing one's legs into other added portions, physically challenged users having special needs for artificial limbs, built-in artificial limbs on second leg-holding portions, etc., may suffice.

Preferably, torso-enclosing mummy-style sleeping bag portion 104 further comprises arm-holding portions 116, preferably two arm-holding portions 116 (at least embodying herein first arm extender means for extending a first arm of the user; and, at least embodying herein second arm extender means for extending a second arm of the user), as shown. Arm-holding portions 116 preferably comprise an opening 146 at each end 162 at least large enough to extend a users hand through, as shown. Arm-holding portions 116 are preferably sewn to torso-enclosing mummy-style sleeping bag portion 104 such that each respective arm-holding portions 116 may be extended away from sleeping bag 102 in a range of motion at least providing arm movement transverse from torso-enclosing mummy-style sleeping bag portion 104 while such user 108 is contained within sleeping bag 102 and, preferably when each respective arm 118 of such user 108 is extended into a respective arm-holding portion 116, as shown (this arrangement at least embodies herein wherein a user may extend both arms transverse from such sleeping bag torso container means while such torso is contained within such sleeping bag torso container means). Further, it is preferable that a user may retract one or both such arms 118 from such respective arm-holding portions 116 and place such arms 118 into the torso-enclosing mummy-style sleeping bag portion 104, such as, for example, for sleep positioning, as shown. Upon reading this specification, those with ordinary skill in the art will now appreciate that, under appropriate circumstances, considering such issues as design preference, user preferences, marketing preferences, cost, structural requirements, available materials, technological advances, etc., other arm placement arrangements such as, for example, placing both arms into a larger first or second arm-holding portion, placing one's arms into other added portions, physically challenged users having special needs for artificial limbs, built-in artificial limbs on arm-holding portions, etc., may suffice.

User 108 entry and exit (ingress and egress) to/from the interior portion 120 of sleeping bag 102 preferably is made through a single zippered opening 122, utilizing at least one zipper 128, preferably situate longitudinally along side portion 124 of sleeping bag 102, preferably single zippered opening 122 and side portion 124 being situate along first leg-holding portion 106, as shown. Preferably, zippered opening 122 comprises a single zipper 128 that may be operated by user 108 from either outside sleeping bag 102 or from interior portion 120. Zippered opening 122 (at least embodying herein wherein such sleeping bag container means comprises at least one ingress-egress means for ingress-egress into such sleeping bag container means; and, at least embodying herein at least one side ingress-egress means for providing side ingress-egress to such sleeping bag torso container means; and, further at least embodying herein wherein such side ingress-egress means provides ingress-egress for at least the torso of such at least one user) preferably starts at the head portion 126 and runs about the length of the side portion 124 of the sleeping bag 102 to a position near the bottom 136 of the first leg-holding portion 106, as shown, so as to allow complete ingress and egress from such sleeping bag 102 by any user 108. Upon reading this specification, those with ordinary skill in the art will now appreciate that, under appropriate circumstances, considering such issues as design preference, user preferences, marketing preferences, cost, structural requirements, available materials, technological advances, etc., other zippered opening arrangements such as, for example, multiple layers, multiple zippers, closures other than zippers, multiple openings, etc., may suffice.

Preferably, sleeping bag 102 comprises at least one hygienic access 130, as shown. Hygienic access 130 preferably comprises at least one opening 132, preferably situate near the groin area 134 of a user 108, preferably situate at least adjacent the intersection of said first leg-holding portion 106 and said second leg-holding portion 110. Hygienic access 130 preferably is situate about the intersection of first leg-holding portion 106 and second leg-holding portion 110 and alternately preferably from about the intersection of first leg-holding portion 106 and second leg-holding portion 110 extending only along second leg-holding portion 110 (at least embodying herein wherein such at least one closable opening is essentially situate along such second leg-container), as shown. Preferably, hygienic access 130 extends from about the intersection of first leg-holding portion 106 and second leg-holding portion 110 from at least about 6 inches to about 24 inches in length. Upon reading this specification, those with ordinary skill in the art will now appreciate that, under appropriate circumstances, considering such issues as design preference, user preferences, marketing preferences, cost, structural requirements, available materials, technological advances, etc., other hygienic access arrangements such as, for example, longer or shorter, wider or thinner, multiple access, multiple access layers, etc., may suffice.

Preferably, hygienic access 130 (at least embodying herein wherein such sleeping bag container further comprises at least one closable opening situate at least at the intersection of such first leg-container and such second leg-container) assists a user in quick access to groin area 134 (at least embodying herein wherein such at least one closable opening is structured and arranged to provide hygienic access to at least the groin area of the at least one user), preferably assisting in bladder release, menstruation maintenance, gaseous release, coitus, and other such wants and needs of a user 108, preferably without such user 108 having to leave the comfort and warmth of the sleeping bag 102; and, preferably allowing user 108 relatively full motion including walking and use of one's arms and hands. Upon reading this specification, those with ordinary skill in the art will now appreciate that, under appropriate circumstances, considering such issues as design preference, user preferences, marketing preferences, cost, structural requirements, available materials, technological advances, etc., other hygienic access arrangements such as, for example, other locations, openings, dimensions, closures, assistive devices, pockets, attachments, heating elements, etc., may suffice.

Figure 3:
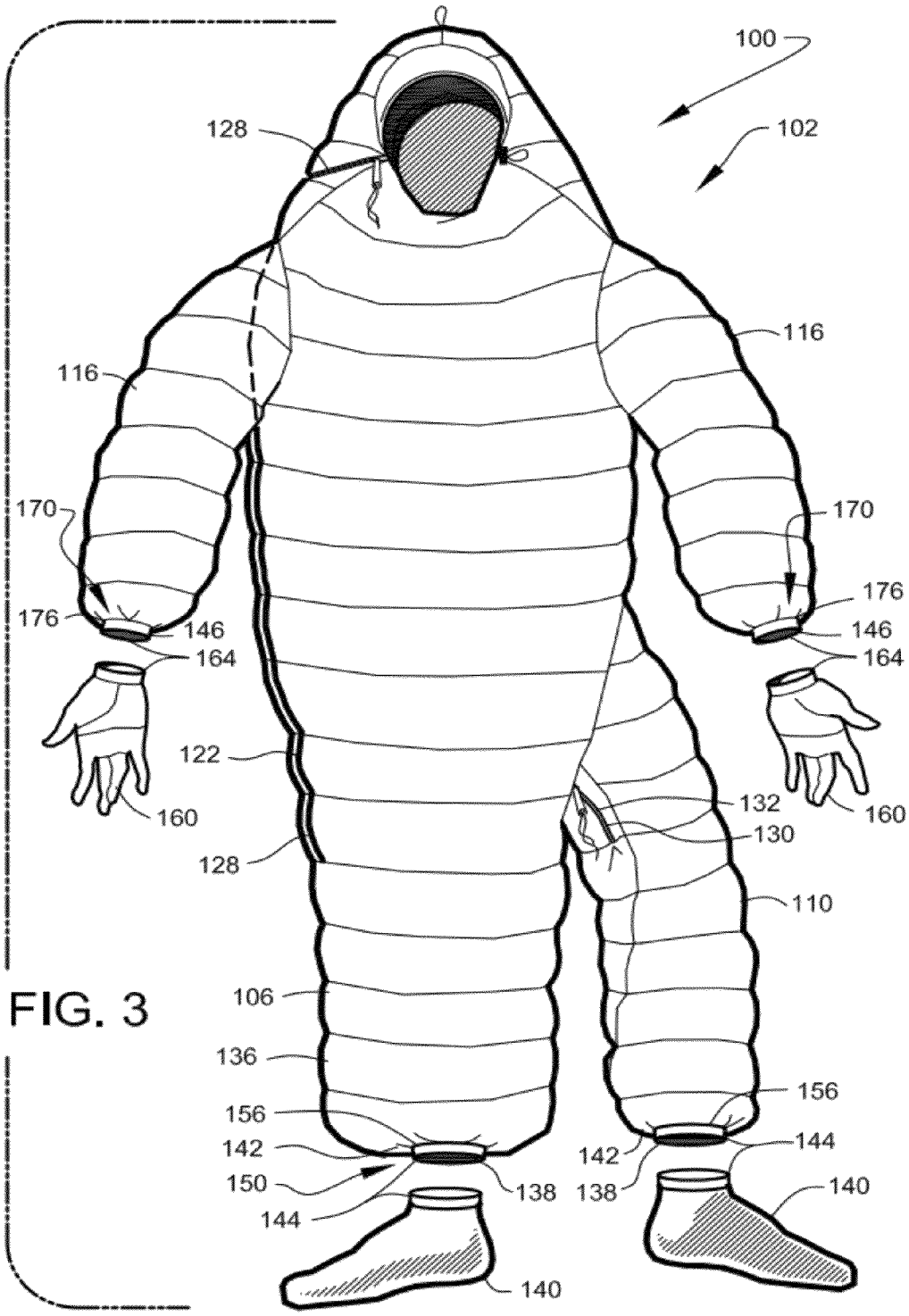
FIG. 3 shows a partially-exploded front perspective view, illustrating the sleeping bag of the sleeping bag systems, according to the preferred embodiment of FIG. 1.

FIG. 3 shows a partially-exploded front perspective view, illustrating the sleeping bag 102 of the sleeping bag systems 100, according to the preferred embodiment of FIG. 1.

Preferably, each respective first leg-holding portion 106 and second leg-holding portion 110 have openings 138 (at least embodying herein wherein such first leg-container comprises a first leg-passage element adapted to assist passage of the first leg of the user outwardly from the first leg-container element; and, at least embodying herein wherein such second leg-container comprises a second leg-passage element adapted to assist passage of the second leg of the user outwardly from the second leg-container element) on each respective end 142 of each respective leg-holding portion 106 and 110, preferably large enough to place at least a user's foot and ankle portion through, preferably assisting walking while in such sleeping bag 102, as shown. The above-described arrangement at least embodies herein wherein such first leg-container means comprises first walk assister means for assisting user walking when a single foot portion of at least one such leg is extended into such first walk assister means; wherein such second leg-container means comprises second walk assister means for assisting user walking when a single foot portion of such leg is extended into such second walk assister means; and wherein such system enables the user to walk around when one of the user's legs is within such first leg-container means and one of the users legs is in such second leg-container means.

Further, each respective first leg-holding portion 106 and second leg-holding portion 110 comprise removably attachable socks 140, preferably located on the end 142 of each respective leg-holding portion 106 and 110, as shown. Preferably, each such sock 140 is appropriately sized for the user, preferably to fit the user's foot, as shown. Preferably, socks 140 are removably attachable utilizing hook and loop fabric 144 wherein one portion of such hook and loop fabric 144 is attached to an end 142 and one portion of such hook and loop fabric 144 is attached to the sock 140, as shown (this arrangement at least embodies herein hook and loop fabric structured and arranged to removably attach such first sock to such first leg-container and such second sock to such second leg-container). In attaching socks 140 in such manner as described above, socks 140 may be removed, washed, or replaced. Further, socks 140 may be interchanged with other socks 140 that may be warmer, thicker, thinner, etc., as selected by such users 108. Socks 140 are preferred over other types of footwear as each individual user is free to determine the footwear they care to utilize by inserting the sock, and respective foot of the user, into such footwear (for example, athletic shoes, boots, sneakers, sippers, waterproof boots, etc.). Preferably, use of an insulated sock, such as a wool sock or heavier-denier sock, preferably assists maintaining an insulated respective leg portion when the legs of the user are fully contained within each respective leg holding portion, or more specifically, contained within the second leg holding portion 110. Upon reading this specification, those with ordinary skill in the art will now appreciate that, under appropriate circumstances, considering such issues as design preference, user preferences, climate, marketing preferences, cost, available materials, technological advances, etc., other sock arrangements such as, for example, waterproof socks, walking socks (having a hard sole), no socks (barefoot), etc., may suffice.

Preferably, when a user's foot is removed from a respective sock 140 and retracted into a leg-holding portion, end 142 preferably comprises at least one closure element 150 (at least embodying herein wherein the first leg-passage element comprises at least one elastic closure structured and arranged to maintain such first leg-passage in a closed position when a leg is not inserted through such first leg-passage; and, at least embodying herein wherein the second leg-passage element comprises at least one elastic closure structured and arranged to maintain such second leg-passage in a closed position when a leg is not inserted through such second leg-passage) and, that will essentially close the opening in such end 142 so that the end 142 substantially insulates the interior portion 120 of the respective leg-holding portion from the exterior environment, as shown. Closure element 150 preferably comprises at least one elastic band 156, preferably placed circumferential about each respective end 142, as shown. Preferably, elastic band 156 exerts a constant force to close end 142 resulting in a tight fit between the end 142 and a user's leg when such user's foot is inserted through such end 142, as shown. Upon reading this specification, those with ordinary skill in the art will now appreciate that, under appropriate circumstances, considering such issues as design preference, user preferences, marketing preferences, cost, structural requirements, available materials, technological advances, etc., other closure elements such as, for example, drawstrings, shoelaces, snaps, zippers, etc., may suffice.

Arm-holding portions 116 preferably comprise an opening 146 at each end 162 at least large enough to extend a users hand through, as shown (this arrangement at least embodies herein wherein the first arm-extender comprises a first hand-passage adapted to assist passage of the first hand of the user outwardly from the first arm-extender element; and, at least embodies herein wherein the second arm-extender comprises a second hand-passage adapted to assist passage of the second hand of the user outwardly from the second arm-extender element). Preferably, each respective arm-holding portion 116 comprises removably attachable gloves 160, preferably located on the end 162 of each respective arm-holding portion 116, as shown. Preferably, each such glove 160 is appropriately sized for the user, preferably to fit the user's hand, as shown. Preferably, gloves 160 are removably attachable utilizing hook and loop fabric 164 wherein one portion of such hook and loop fabric 164 is attached to an end 162 and one portion of such hook and loop fabric 164 is attached to the glove 160, as shown (this arrangement at least embodies herein hook and loop fabric structured and arranged to removably attach such first glove to such first arm-extender element and such second glove to such second arm-extender element). In attaching the gloves 160 in such manner as described above, gloves 160 may be removed, washed, or replaced. Further, the gloves 160 may be interchanged with other gloves 160 that may be warmer, thicker, thinner, etc., as selected by such users 108.

As described above in relation to first leg-holding portion 106 and second leg-holding portion 110, arm-holding portions 116 similarly preferably comprise at least one closure element 170 that will essentially close the opening in such end 162 so that the end 162 substantially insulates the interior portion 120 of the respective arm-holding portion from the exterior environment, as shown. Closure element 170 (at least embodying herein wherein the first hand-passage comprises at least one elastic closure structured and arranged to maintain such first hand-passage in a closed position when a hand is not inserted through such first hand-passage; and, at least embodying herein wherein the second hand-passage comprises at least one elastic closure structured and arranged to maintain such second hand-passage in a closed position when a hand is not inserted through such second hand-passage) preferably comprises at least one elastic band 176, preferably placed circumferential about each respective end 162, as shown. Preferably, elastic band 176 exerts a constant force to close end 162 resulting in a tight fit between the end 162 and a user's arm when such user's hand is inserted through such end 162, and into gloves 160, as shown. Further, elastic band 176 preferably exerts a constant force to close end 162 when a user's arm and such user's hand are removed through such end 162 and glove 160, as shown. Upon reading this specification, those with ordinary skill in the art will now appreciate that, under appropriate circumstances, considering such issues as design preference, user preferences, marketing preferences, cost, structural requirements, available materials, technological advances, etc., other closure elements such as, for example, drawstrings, shoelaces, snaps, zippers, etc., may suffice.

Applicant prefers that the arm-holding portions be sewn adjacent the side seams of the sleeping bag 102 at about standard shoulder to arm proportioning; preferred positioning is generally consistent with median anthropomorphic (human form) dimensions of the selected-size of preferred purchaser or user of such sleeping bag systems 100 (for example, sleeping bag sizing for female, male, petite, tall, large, etc.). Those with ordinary skill in the art will now appreciate that upon reading this specification and by their understanding the art of stitching attachment as described herein, methods of such stitching and attachment will be understood by those knowledgeable in such art.

Further, second-leg holding portion 110 is preferably stitch-attached at about the groin location of the preferred position as generally consistent with median anthropomorphic (human form) dimensions of any given selected-size of preferred purchaser or user of such sleeping bag systems 100 (for example, sleeping bag sizing for female, male, petite, tall, large, etc.). Those with ordinary skill in the art will now appreciate that upon reading this specification and by their understanding the art of stitching attachment as described herein, methods of such stitching and attachment will be understood by those knowledgeable in such art.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A sleeping bag system, relating to providing at least one user with a sleeping bag which may be used for both sleeping and walking around, comprising:

a) at least one sleeping bag container structured and arranged to contain at least the torso of the at least one user;

b) wherein said at least one sleeping bag container comprises at least one ingress-egress element adapted to assist ingress-egress into and out of said at least one sleeping bag container;

c) wherein said at least one sleeping bag container comprises a first leg-container adapted to hold at least both legs of the at least one user;

d) wherein said at least one sleeping bag container comprises a second leg-container adapted to hold only one leg of the at least one user;

e) wherein said at least one sleeping bag container comprises at least one insulator element adapted to provide insulation to such at least one user when such at least one user is at least partially contained within said at least one sleeping bag container;

f) wherein said first leg-container comprises at least one first walk assister adapted to assist the at least one user walking when at least a first single foot portion of at least one first such leg is extended into said at least one first walk assister;

g) wherein said second leg-container comprises at least one second walk assister adapted to assist the at least one user walking when at least a second single foot portion of at least one second such leg is extended into said at least one second walk assister;

h) wherein said system enables the at least one user to walk around when one kg of the at least one user is within said first leg-container and one leg of the at least one user is in said second leg-container; and i) wherein said system assists the at least one user to sleep in said at least one sleeping bag container with both legs of the at least one user in said first leg-container;

j) wherein said at least one sleeping bag container further comprises:

i) a first arm-extender element adapted to assist extending a first arm of the at least one user; and ii) a second arm-extender element adapted to assist extending a second arm of the at least one user;

iii) wherein the at least one user may extend both arms in a range of motion at least transverse from said at least one sleeping bag container while the at least one user is contained within said at least one sleeping bag container;

k) wherein said first arm-extender element comprises at least one first glove adapted to allow insertion of a first hand of the at least one user into said at least one first glove;

l) wherein said second arm-extender element comprises at least one second glove adapted to allow insertion of a second hand of the at least one user into said at least one second glove;

m) wherein:

i) said at least one first glove is removably attachable to said first arm-extender element, and ii) said at least one second glove is removably attachable to said second arm-extender element;

n) wherein said first arm-extender element comprises a first hand-passage adapted to assist passage of the first hand of the at least one user outwardly from said first arm-extender element; and o) wherein said first hand-passage comprises at least one elastic closure structured and arranged to maintain said first hand-passage in a closed position when a hand is not inserted through said first hand-passage.

2. A sleeping bag system, relating to providing at least one user with a sleeping bag which may be used for both sleeping and walking around, comprising:

a) at least one sleeping bag container structured and arranged to contain at least the torso of the at least one user;

b) wherein said at least one sleeping bag container comprises at least one ingress-egress element adapted to assist ingress-egress into and out of said at least one sleeping bag container;

c) wherein said at least one sleeping bag container comprises a first leg-container adapted to hold at least both legs of the at least one user;

d) wherein said at least one sleeping bag container comprises a second leg-container adapted to hold only one leg of the at least one user;

e) wherein said at least one sleeping bag container comprises at least one insulator element adapted to provide insulation to such at least one user when such at least one user is at least partially contained within said at least one sleeping bag container;

f) wherein said first leg-container comprises at least one first walk assister adapted to assist the at least one user walking when at least a first single foot portion of at least one first such leg is extended into said at least one first walk assister;

g) wherein said second leg-container comprises at least one second walk assister adapted to assist the at least one user walking when at least a second single foot portion of at least one second such leg is extended into said at least one second walk assister;

h) wherein said system enables the at least one user to walk around when one of the at least one user's legs is within said first leg-container and one of the at least one user's legs is in said second leg-container;

i) wherein said system assists the at least one user to sleep in said at least one sleeping bag container with both legs of the at least one user in said first leg-container;

j) wherein said first leg-container comprises at least one first sock adapted to allow insertion of a first foot of the at least one user into said at least one first sock;

k) wherein said second leg-container comprises at least one second sock adapted to allow insertion of a second foot of the at least one user into said at least one second sock;

l) wherein i) said at least one first sock is removably attachable to said first leg-container, and ii) said at least one second sock is removably attachable to said second leg-container;

m) wherein said first leg-container comprises a first leg-passage element adapted to assist passage of the first leg of the at least one user outwardly from said first leg-container; and n) wherein the first leg-passage element comprises at least one elastic closure structured and arranged to maintain said first leg-passage element in a closed position when a leg is not inserted through said first leg-passage element.

3. A sleeping bag system, relating to providing at least one user with a sleeping bag which may be used for both sleeping and walking around, comprising:

a) at least one sleeping bag container structured and arranged to contain at least the torso of the at least one user;

b) wherein said at least one sleeping bag container comprises at least one ingress-egress element adapted to assist ingress-egress into and out of said at least one sleeping bag container;

c) wherein said at least one sleeping bag container comprises a first leg-container adapted to hold at least both legs of the at least one user;

d) wherein said at least one sleeping bag container comprises a second leg-container adapted to hold only one leg of the at least one user;

e) wherein said at least one sleeping bag container comprises at least one insulator element adapted to provide insulation to such at least one user when such at least one user is at least partially contained within said at least one sleeping bag container;

f) wherein said first leg-container comprises at least one first walk assister adapted to assist the at least one user walking when at least a first single foot portion of at least one first such leg is extended into said at least one first walk assister;

g) wherein said second leg-container comprises at least one second walk assister adapted to assist the at least one user walking when at least a second single foot portion of at least one second such leg is extended into said at least one second walk assister;

h) wherein said system enables the at least one user to walk around when one of the at least one user's legs is within said first leg-container and one of the at least one user's legs is in said second leg-container;

i) wherein said system assists the at least one user to sleep in said at least one sleeping bag container with both legs of the at least one user in said first leg-container;

j) wherein said at least one sleeping bag container further comprises i) a first arm-extender element adapted to assist extending a first arm of the at least one user, and ii) a second arm-extender element adapted to assist extending a second arm of the at least one user, iii) wherein the at least one user may extend both arms in a range of motion at least transverse from said at least one sleeping bag container while the at least one user is contained within said at least one sleeping bag container;

k) wherein said first arm-extender element comprises a first hand-passage adapted to assist passage of the first hand of the at least one user outwardly from said first arm-extender element; and l) wherein said first hand-passage comprises at least one elastic closure structured and arranged to maintain said first hand-passage in a closed position when a hand is not inserted through said first hand-passage.

4. A sleeping bag system, relating to providing at least one user with a sleeping bag which may be used for both sleeping and walking around, comprising:

a) at least one sleeping bag container structured and arranged to contain at least the torso of the at least one user;

b) wherein said at least one sleeping bag container comprises at least one ingress-egress element adapted to assist ingress-egress into and out of said at least one sleeping bag container;

c) wherein said at least one sleeping bag container comprises a first leg-container adapted to hold at least both legs of the at least one user;

d) wherein said at least one sleeping bag container comprises a second leg-container adapted to hold only one leg of the at least one user;

e) wherein said at least one sleeping bag container comprises at least one insulator element adapted to provide insulation to such at least one user when such at least one user is at least partially contained within said at least one sleeping bag container;

f) wherein said first leg-container comprises at least one first walk assister adapted to assist the at least one user walking when at least a first single foot portion of at least one first such leg is extended into said at least one first walk assister;

g) wherein said second leg-container comprises at least one second walk assister adapted to assist the at least one user walking when at least a second single foot portion of at least one second such leg is extended into said at least one second walk assister;

h) wherein said system enables the at least one user to walk around when one of the at least one user's legs is within said first leg-container and one of the at least one user's legs is in said second leg-container;

i) wherein said system assists the at least one user to sleep in said at least one sleeping bag container with both legs of the at least one user in said first leg-container;

j) wherein said first leg-container comprises a first leg-passage element adapted to assist passage of the first leg of the at least one user outwardly from said first leg-container; and k) wherein the first leg-passage element comprises at least one elastic closure structured and arranged to maintain said first leg-passage element in a closed position when a leg is not inserted through said first leg-passage element.

5. The sleeping bag system according to claim 1 wherein said at least one ingress-egress element comprises:

a) at least one side ingress-egress element adapted to providing side ingress-egress to said at least one sleeping bag container;

b) wherein said side ingress-egress element provides ingress-egress access to at least the torso of the at least one user.

6. The sleeping bag system according to claim 5 wherein said side ingress-egress element comprises at least one zipper.

7. The sleeping bag system according to claim 1 wherein said second arm-extender element comprises a second hand-passage adapted to assist passage of the second hand of the at least one user outwardly from said second arm-extender element.

8. The sleeping bag system according to claim 7 wherein said second hand-passage comprises at least one elastic closure structured and arranged to maintain said second hand-passage in a closed position when a hand is not inserted through said second hand-passage.

9. The sleeping bag system according to claim 2 wherein said second leg-container comprises a second leg-passage element adapted to assist passage of the second leg of the at least one user outwardly from said second leg-container.

10. The sleeping bag system according to claim 9 wherein the second leg-passage element comprises at least one elastic closure structured and arranged to maintain said second leg-passage in a closed position when a leg is not inserted through said second leg-passage element.

11. The sleeping bag system according to claim 1 wherein said at least one sleeping bag container further comprises at least one closable opening situate at least at the intersection of said first leg-container and said second leg-container.

12. The sleeping bag system according to claim 11 wherein said at least one closable opening comprises at least one zipper structured and arranged to both open said at least one closable opening and close said at least one closable opening.

13. The sleeping bag system according to claim 11 wherein said at least one closable opening is structured and arranged to provide hygienic access to at least the groin area of the at least one user.

14. The sleeping bag system according to claim 11 wherein said at least one closable opening is about six-inches to about twenty four inches in length.

15. The sleeping bag system according to claim 11 wherein said at least one closable opening is essentially situate along said second leg-container.

16. The sleeping bag system according to claim 1 further comprising hook and loop fabric structured and arranged to removably attach said at least one first glove to said first arm-extender element and said at least one second glove to said second arm-extender element.

17. The sleeping bag system according to claim 2 further comprising hook and loop fabric structured and arranged to removably attach said at least one first sock to said first leg-container and said at least one second sock to said second leg-container.

18. The sleeping bag system according to claim 3 wherein said second arm-extender element comprises a second hand-passage adapted to assist passage of the second hand of the at least one user outwardly from said second arm-extender element.

19. The sleeping bag system according to claim 18 wherein said second hand-passage comprises at least one elastic closure structured and arranged to maintain said second hand-passage in a closed position when a hand is not inserted through said second hand-passage.

20. The sleeping bag system according to claim 3 wherein said first arm-extender element comprises at least one first glove adapted to allow insertion of a first hand of the at least one user into said at least one first glove.

21. The sleeping bag system according to claim 20 wherein said second arm-extender element comprises at least one second glove adapted to allow insertion of a second hand of the at least one user into said at least one second glove.

22. The sleeping bag system according to claim 21 wherein:

a) said at least one first glove is removably attachable to said first arm-extender element, and b) said at least one second glove is removably attachable to said second arm-extender element.

23. The sleeping bag system according to claim 4 wherein said second leg-container comprises a second leg-passage element adapted to assist passage of the second leg of the at least one user outwardly from said second leg-container.

24. The sleeping bag system according to claim 23 wherein the second leg-passage element comprises at least one elastic closure structured and arranged to maintain said second leg-passage in a closed position when a leg is not inserted through said second leg-passage element.

25. The sleeping bag system according to claim 4 wherein said first leg-container comprises at least one first sock adapted to allow insertion of a first foot of the at least one user into said at least one first sock.

26. The sleeping bag system according to claim 25 wherein said second leg-container comprises at least one second sock adapted to allow insertion of a second foot of the at least one user into said at least one second sock.

27. The sleeping bag system according to claim 26 wherein:

a) said at least one first sock is removably attachable to said first leg-container; and b) said at least one second sock is removably attachable to said second leg-container.

* * * * *